US011384708B1

(12) United States Patent
Schroeder et al.

(10) Patent No.: US 11,384,708 B1
(45) Date of Patent: Jul. 12, 2022

(54) ENGINE SYSTEM OPERATING STRATEGY APPORTIONING FUEL INJECTION BETWEEN UPSTREAM AND DOWNSTREAM INJECTION LOCATIONS

(71) Applicant: Caterpillar Inc., Peoria, IL (US)

(72) Inventors: Eric Lee Schroeder, Germantown Hills, IL (US); David Todd Montgomery, Edelstein, IL (US); Arnold Myoungjin Kim, Peoria, IL (US); Michael Bardell, Peoria, IL (US); Nikolas Karl Landin, Colorado Springs, CO (US); Kenth I. Svensson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/355,680

(22) Filed: Jun. 23, 2021

(51) Int. Cl.

| | |
|---|---|
| ***F02D 41/30*** | (2006.01) |
| ***F02D 19/06*** | (2006.01) |
| ***F02M 35/104*** | (2006.01) |
| ***F02M 31/20*** | (2006.01) |

(52) U.S. Cl.
CPC ..... *F02D 41/30* (2013.01); *F02D 19/0655* (2013.01); *F02D 19/0694* (2013.01); *F02M 31/20* (2013.01); *F02M 35/104* (2013.01); *F02D 2200/0414* (2013.01); *F02D 2200/0614* (2013.01)

(58) Field of Classification Search
CPC .. F02D 41/30; F02D 19/0655; F02D 19/0694; F02D 2200/0414; F02D 2200/0614; F02M 31/20; F02M 35/104
USPC ..... 123/299, 300, 435, 540–543, 559.1
See application file for complete search history.

(56) References Cited

U.S. PATENT DOCUMENTS

| | | | | |
|---|---|---|---|---|
| 9,874,180 | B2 | 1/2018 | Sakairi et al. | |
| 10,145,319 | B1 * | 12/2018 | Engfehr | F02D 41/0027 |
| 10,323,586 | B1 * | 6/2019 | Atterberry | F02D 19/081 |
| 10,697,401 | B2 | 6/2020 | Hoffmann | |
| 11,078,827 | B2 * | 8/2021 | Chang | F02B 19/06 |
| 2015/0226144 | A1 | 8/2015 | Sixel et al. | |
| 2021/0040884 | A1 | 2/2021 | Hoffmann | |

FOREIGN PATENT DOCUMENTS

| | | | |
|---|---|---|---|
| DE | 202007011214 | U1 | 2/2008 |
| JP | 2015221645 | A | 12/2015 |
| JP | 2021001591 | A | 1/2021 |
| WO | 2020230979 | A1 | 11/2020 |

* cited by examiner

*Primary Examiner* — Hai H Huynh
(74) *Attorney, Agent, or Firm* — Brannon Sowers & Cracraft

(57) ABSTRACT

Operating an engine includes injecting a liquid alcohol fuel such as methanol into a stream of compressed intake air at an upstream injection location, and injecting the liquid fuel at a plurality of downstream injection locations into a plurality of streams of the compressed intake air from an intake manifold to combustion cylinders in the engine. A fueling control unit apportions a total injected quantity of the liquid fuel between the upstream injection location and the plurality of downstream injection locations based on a temperature parameter of the compressed intake air. The compressed intake air is combusted with the liquid fuel and a compression ignition pilot fuel in the plurality of combustion cylinders.

20 Claims, 2 Drawing Sheets

ENGINE SYSTEM OPERATING STRATEGY APPORTIONING FUEL INJECTION BETWEEN UPSTREAM AND DOWNSTREAM INJECTION LOCATIONS

TECHNICAL FIELD

The present disclosure relates generally to operating an internal combustion engine, and more particularly to apportioning liquid fuel between an upstream injection location and a plurality of downstream injection locations based on a temperature parameter of compressed intake air.

BACKGROUND

Internal combustion engines are widely used throughout the world for purposes ranging from electrical power generation to land vehicle and marine vessel propulsion, pumps, compressors, and a great many different industrial applications. Internal combustion engines can operate on a variety of different liquid fuels, gaseous fuels, and various blends. Spark-ignited engines employ an electrical spark to initiate combustion of fuel and air, whereas compression ignition engines typically compress gases in a cylinder to an autoignition threshold such that ignition of fuel begins without requiring a spark. In well-known pilot-ignited strategies, including dual fuel strategies, a mixture of a gaseous fuel, such as natural gas, and air is delivered into a cylinder and ignition triggered using a relatively small direct injection of a compression ignition fuel which autoignites to trigger ignition of the relatively larger main charge. Engineers have experimented with many different variations and permutations of these general strategies over the years, including efforts to implement a wide range of fuel types.

More recently, research efforts have focused on the use of so-called alternative fuels in single-fuel and dual fuel engines, including various alcohol fuels such as methanol. Strategies are known where methanol is directly injected into an engine cylinder and the methanol is ignited with a pilot fuel or a spark. Methanol tends to have a high latent heat of vaporization. As a result it can be challenging in some instances to vaporize liquid alcohol fuels to a desired extent, resulting in dripping or dribbling of liquid alcohol fuel at certain points in an engine system. Ultimately, known strategies can fail to vaporize sufficient alcohol quantities to satisfy engine load demands. Moreover, alcohol fuel in liquid form can have various deleterious effects on engine operation and performance. It remains desirable to seek improvements relating to alcohol and other alternative fuel engines, especially in the marine engine context where increased alcohol fuel adoption holds promise for reduction of certain emissions. One example engine and methodology having marine propulsion applications is known from United States Patent Application Publication No. 20150226144 A1 to Sixel et al.

SUMMARY OF THE INVENTION

In one aspect, a method of operating an engine includes feeding compressed intake air from a compressor to a plurality of combustion cylinders in an engine. The method further includes injecting a liquid fuel into a stream of the compressed intake air at an upstream injection location fluidly between the compressor and an aftercooler, and injecting the liquid fuel at a plurality of downstream injection locations into a plurality of streams of the compressed intake air from an intake manifold to the plurality of combustion cylinders. The method further includes apportioning a total injected quantity of the liquid fuel between the upstream injection location and the plurality of downstream injection locations based on a temperature parameter of the compressed intake air, and combusting the compressed intake air and the injected fuel in the plurality of combustion cylinders.

In another aspect, an engine system includes an engine having a plurality of combustion cylinders formed therein, and an intake system including an intake manifold, a compressor, and an aftercooler arranged to cool a stream of compressed intake air from the compressor to the intake manifold. The engine system further includes an upstream fuel injector arranged to inject a liquid fuel at an upstream injection location into the stream of compressed intake air from the compressor to the intake manifold, and a plurality of downstream fuel injectors each arranged to inject the liquid fuel at one of a plurality of downstream injection locations into streams of compressed intake air from the intake manifold to each of the plurality of combustion cylinders. The engine system still further includes a temperature sensor structured to monitor a temperature of the compressed intake air, and a fueling control unit coupled to the temperature sensor and structured to apportion a total injected quantity of the liquid fuel between the upstream injection location and the plurality of downstream injection locations based on the monitored temperature.

In still another aspect, a fuel system for an internal combustion engine includes an upstream fuel injector structured to inject a liquid alcohol fuel into a stream of compressed intake air from a compressor to an intake manifold of the internal combustion engine, and a plurality of downstream fuel injectors each structured to inject the liquid alcohol fuel into a different stream of compressed intake air from the intake manifold to one of a plurality of combustion cylinders of the internal combustion engine. The fuel system still further includes a fueling control unit structured to apportion a total injected quantity of the liquid alcohol fuel for injection between the upstream fuel injector and the plurality of downstream fuel injectors based on a temperature of the compressed intake air.

DETAILED DESCRIPTION

Figure 1:
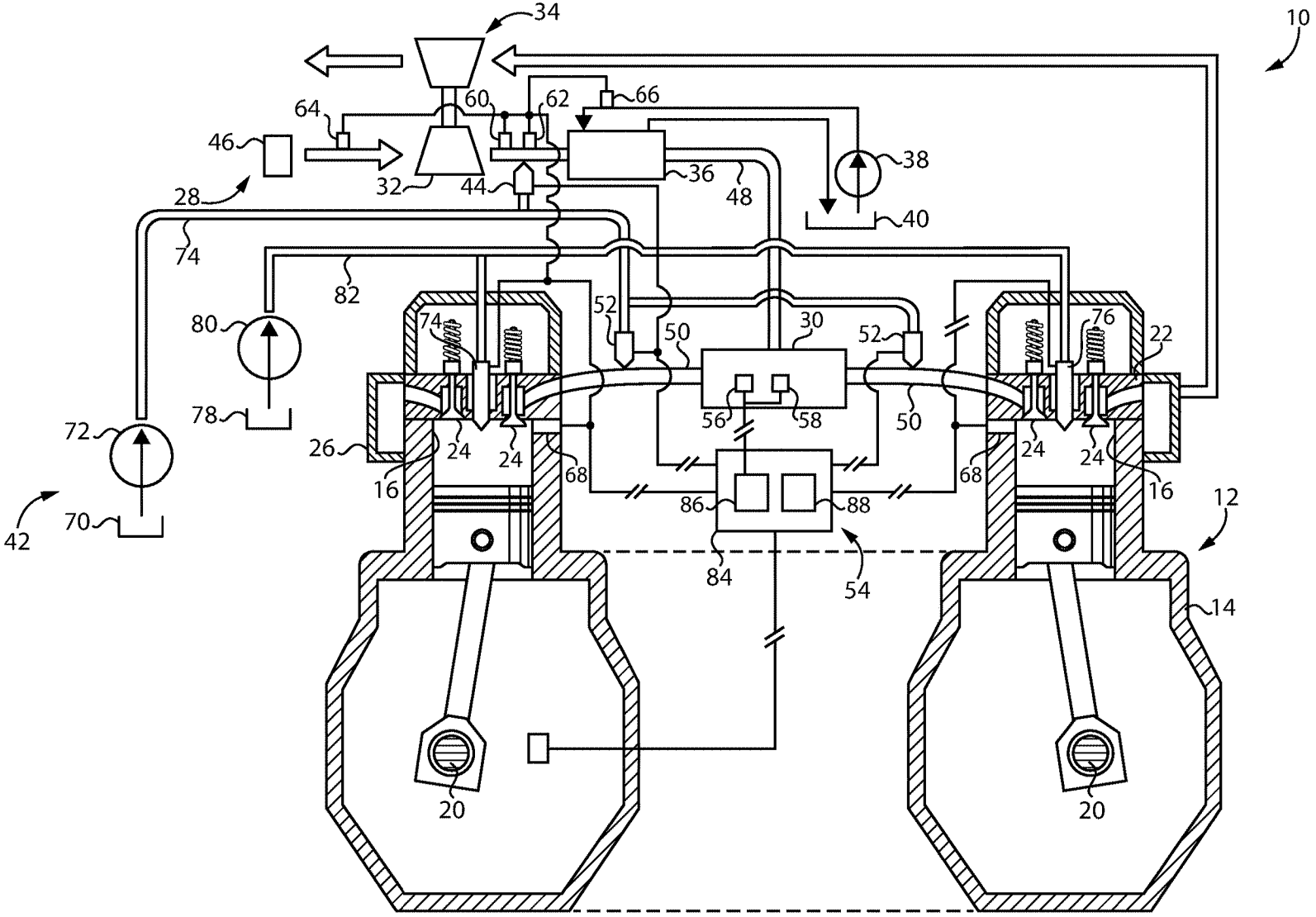
FIG. 1 is a diagrammatic view of an internal combustion engine system, according to one embodiment.

Referring to FIG. 1, there is shown an internal combustion engine system 10, according to one embodiment. Engine system 10 includes an internal combustion engine 12 having an engine housing 14 with a plurality of combustion cylinders 16 formed therein. A plurality of pistons 18 are positioned within combustion cylinders 16 and movable between a bottom dead center position and a top dead center position to rotate a crankshaft 20 in a generally conventional manner. An engine head 22 is attached to engine housing 14 and supports engine valves 24 movable to control fluid connections between combustion cylinders 16 and an exhaust manifold 26 and an intake manifold 30 in an intake system 28. Engine 12 can operate in a four-stroke engine cycle, or potentially a two-stroke engine cycle, for example. Pistons 18 and combustion cylinders 16 can include any number of pistons and cylinders in any suitable arrangement such as an inline pattern, a V-pattern, or still another. Example applications of engine system 10 include electrical power generation such as in a generator set, for propulsion in a land vehicle, and in marine propulsion, pumping, and compressor applications to name a few examples. In some instances, the arrangement of engine housing 14 and engine head 22 as well as the locations of engine valves 24 and the various fluid conduits associated with engine 12 could vary from the configurations illustrated in FIG. 1.

Intake system 28 further includes a compressor 32 in a turbocharger 34 and structured to operate in a generally conventional manner to compress a flow of intake air for combustion received by way of an air filter 46. Compressed intake air is fed in a stream from compressor 32 to intake manifold 30 by way of an aftercooler 36 arranged to cool the stream of compressed intake air from compressor 32 to intake manifold 30. Aftercooler 36 may be a liquid cooled aftercooler associated with a coolant pump 38 that conveys a flow of a liquid coolant from a tank 40 through aftercooler 36. The compressed and cooled intake air travels from aftercooler 36 through an intake conduit 48 to intake manifold 30, and then through a plurality of intake runners 40 each arranged to feed a different stream of compressed intake air and fuel, as further discussed herein, to one of combustion cylinders 16. As will be further apparent from the following description, engine system 10 is uniquely configured to apportion delivery of a liquid fuel at upstream and downstream injection locations to optimize a quantity of liquid fuel that can be successfully delivered and vaporized.

To this end, engine system 10 further includes a fuel system 42 including multiple fuel supplies and multiple fuel delivery apparatuses. Fuel system 42 may include a first fuel supply including a liquid alcohol fuel supply 70 fluidly connected to each of an upstream fuel injector 44 and a plurality of downstream fuel injectors 52. Upstream fuel injector 44 may be arranged to inject the liquid fuel from liquid alcohol fuel supply 70 at an upstream injection location into the stream of compressed intake air from compressor 32 to intake manifold 30. In the illustrated embodiment, the upstream injection location is at or just downstream of compressor 32, and upstream of aftercooler 36. In the context of intake system 28 "upstream" means in a direction of air filter 46 and "downstream" means an opposite direction toward combustion cylinders 16. The plurality of downstream fuel injectors 52 are each arranged to inject the liquid fuel, such as the liquid alcohol fuel, at one of a plurality of downstream injection locations into different streams of compressed intake air from intake manifold 30 to each of combustion cylinders 16. The downstream injection locations are port injection locations of intake runners 50 in the illustrated embodiment.

Fuel system 42 may further include a second fuel supply including a liquid compression ignition fuel supply 78 fluidly connected to each of a plurality of direct injection fuel injectors 76. A first fuel pump 72 is arranged to convey the liquid fuel from fuel supply 70 to a conduit 74 to each of upstream fuel injector 44 and downstream fuel injectors 52. A second fuel pump 80 is arranged to convey liquid compression ignition fuel from fuel supply 78 to a conduit 82 extending to each of direct injection fuel injectors 76. In a practical implementation strategy liquid alcohol fuel supply 70 stores methanol, or another suitable liquid alcohol fuel or blend. Liquid compression ignition fuel supply 78 may store a suitable high cetane number fuel or cetane-enhanced fuel for compression ignition pilot operation, such as a diesel distillate fuel, dimethyl ether, JP5, JP8, or various other fuels or blends. References herein to diesel are illustrative only and should be understood to refer analogously to any other compression-ignition fuels or blends that might be used. In certain applications it will be desirable to operate engine system 10 predominantly on the liquid alcohol fuel with a relatively tiny amount of the liquid compression ignition fuel used to ignite the liquid alcohol fuel once vaporized in individual combustion cylinders 16. As noted, direct injection fuel injectors 76 can directly inject the liquid compression ignition fuel. In other embodiments, rather than a dual fuel pilot ignition strategy spark-ignition or glowplug-ignition of the alcohol fuel could be used.

Engine system 10 may further include a fuel control system 54. Fuel control system 54 may be configured to apportion a total injected quantity of the liquid alcohol fuel between the upstream injection location and the plurality of downstream injection locations based on a temperature parameter of compressed intake air as further discussed herein. Control system 54 may include a variety of sensors operable to monitor a variety of different temperature and pressure parameters in engine system 10. It should also be appreciated that so-called virtual sensors could be used to monitor, estimate, or infer many of the same pressure and temperature parameters of interest.

In the illustrated embodiment, control system 54 includes a temperature sensor 56 structured to monitor a temperature parameter of the compressed intake air. In a refinement, the temperature parameter thus monitored may be an intake manifold air temperature (IMAT). Thus, the apportionment of a total injected quantity of liquid fuel as discussed herein may be based on the monitored IMAT. Other temperature measurements, estimates or inferences, including temperatures or changes in temperature, can serve as a basis for apportionment or be part of the apportionment calculations further discussed herein. Control system 54 may also include a compressor outlet temperature sensor 60 and a compressor outlet pressure sensor 62 each arranged at, or just downstream of, compressor 32. An intake air pressure sensor 64 may also be part of control system 54, positioned fluidly between compressor 32 and air filter 46. Control system 54 may also include an aftercooler temperature sensor 66 or another sensor or sensor group configured to monitor a temperature parameter of aftercooler 36. Aftercooler temperature sensor 66 may include a temperature sensor structured to monitor an inlet temperature of coolant to be fed through aftercooler 36 in one embodiment. In other embodiments, sensors associated with aftercooler temperature sensor could monitor coolant flow or still other factors relating to an instant or expected cooling efficacy of aftercooler 36. Control system 54 may also include an intake manifold air pressure (IMAP) sensor 58 in some embodiments. Control system 54 may further include cylinder pressure sensors 68 each structured to monitor a cylinder pressure in one of combustion cylinders 16 for purposes of cylinder balancing as also further discussed herein.

Control system 54 also includes a fueling control unit 84 coupled to temperature sensor 56 and structured to perform the apportionment of a total injected quantity of the liquid fuel between the upstream injection location and the plurality of downstream injection locations based on the monitored temperature of the compressed intake air at intake manifold 30, or at another suitable monitoring location. Fueling control unit 84 includes a data processor 86, including any suitable processor such as a microprocessor or a microcontroller, and a computer readable memory 86 including RAM, ROM, DRAM, SDRAM, FLASH, or still another. As suggested above, while at least one temperature associated with compressed intake air in engine system 10 will typically be directly and actually monitored, various virtual sensor arrangements, configurations, and logic functions will be apparent to those skilled in the art. Temperature sensor 56 will typically be arranged to monitor a temperature of the compressed intake air at a location fluidly between aftercooler 36 and at least one of the downstream injection locations.

It will be recalled that due to a relatively high latent heat of evaporation, liquid alcohol fuel can sometimes be challenging to fully vaporize in an engine system. In certain instances, such as at startup or while operating at low engine loads, in very cold ambient conditions or, for instance, using very cold sea water in an aftercooler, a temperature of compressed intake air may not be sufficient at least at certain locations in an engine system to vaporize liquid alcohol fuel to satisfy a desired load demand. It will often be desirable to operate engine system 10 with as high a substitution ratio of liquid alcohol fuel to diesel fuel, or another compression-ignition fuel as noted herein, as can be practicably achieved. In a solely port injected liquid alcohol system relatively lower compressed intake air temperatures can be associated with insufficient evaporation and thus limit the substitution ratio of liquid alcohol fuel to diesel fuel that can be achieved. According to the present disclosure, and in recognition of the typically hot intake air conditions at a compressor outlet, some of the liquid alcohol fuel can be injected at the upstream injection locations and some injected at the downstream injection locations to satisfy load demands up to a rated load, at least, and optimize substitution ratios which can be 95% or higher, potentially 99% or higher in some instances.

Fueling control unit 84 may be further structured to determine a compressor outlet temperature value, and to determine a compressor outlet pressure value. The determined compressor outlet temperature value and the determined compressor outlet pressure value could be a compressor outlet temperature or an estimate obtained by virtual sensor(s), and the determined compressor outlet pressure value can be a sensed pressure or an estimated pressure determined virtually as well. In either case the determined value can be a numeric value. In an embodiment, fueling control unit 84 can determine, based on a monitored IMAT, a fuel injection quantity of the liquid fuel to be injected. The determined fuel injection quantity can be a maximum downstream injection quantity, such as grams or milligrams of fuel, that can be expected to be vaporized based on the IMAT. In other words, during operation fueling control unit 84 monitors IMAT and then determines a maximum fuel injection amount per cylinder that can be injected. In addition to or instead of IMAT, intake manifold pressure (IMAP) might be used. Fueling control unit 84 may also determine, based on the determination of the maximum downstream injection quantity, a balance of the liquid fuel to be injected at the upstream injection location.

It will also be recalled compressor outlet temperature and compressor outlet pressure can be monitored. Based on the determined compressor outlet temperature value and the compressor outlet pressure value an injected quantity of liquid fuel at the upstream injection location can be limited. In particular, where the compressor outlet temperature value and the compressor outlet pressure value are indicative of a liquid fuel evaporation limit of the compressed intake air the injected quantity of liquid fuel at the upstream injection location may be limited to the limit. Another way to understand the described logic is that a balance of liquid fuel quantity optimally injected at the upstream injection location is determined, but if conditions suggest that injecting the balance would be likely to result in some of the liquid fuel not evaporating then a lesser amount will be injected. The liquid fuel evaporation limit could be an actual maximum fuel quantity that can theoretically be evaporated, although the limit implemented in the control logic may represent a quantity at a safety margin or tolerance less than the theoretical limit. In such situations a quantity of a second fuel injected, in the described instance directly injected diesel fuel, can be increased to compensate for the limitation to the quantity of the liquid fuel injected at the upstream injection location. Much of the time during operating engine system 10 the compressed intake air may have sufficient capacity to vaporize all of the liquid fuel injected at the upstream injection location and no compensation for the limitation will be necessary.

Fueling control unit 84 may be further structured to determine an aftercooler temperature value based, for example, on an input from temperature sensor 66 or an aftercooler temperature value determined virtually. There also may be some instances, such as where aftercooler 66 is supplied with very cold sea water, that the compressed intake air conveyed through aftercooler 36 would be cooled to the point where previously injected alcohol condenses or fails to fully evaporate. In such instances, fueling control unit 84 might perform the apportionment of the total injected quantity of the liquid fuel by biasing the total liquid fuel quantity to be injected in favor of the downstream injection locations to avoid condensation. In other instances, fueling control unit 84 might simply limit the total injected quantity of the liquid fuel and rely upon the directly injected diesel fuel to satisfy engine load requirements. Still another way to understand the described concepts is that fueling control unit 84 determines a maximum quantity of the liquid fuel to inject at the downstream location, and then injects the balance of the total at the upstream injection location but potentially limited in some way based on the capacity of the compressed intake air at the compressor outlet or in the aftercooler to evaporate and/or maintain vaporized the injected liquid fuel.

INDUSTRIAL APPLICABILITY

Figure 2:
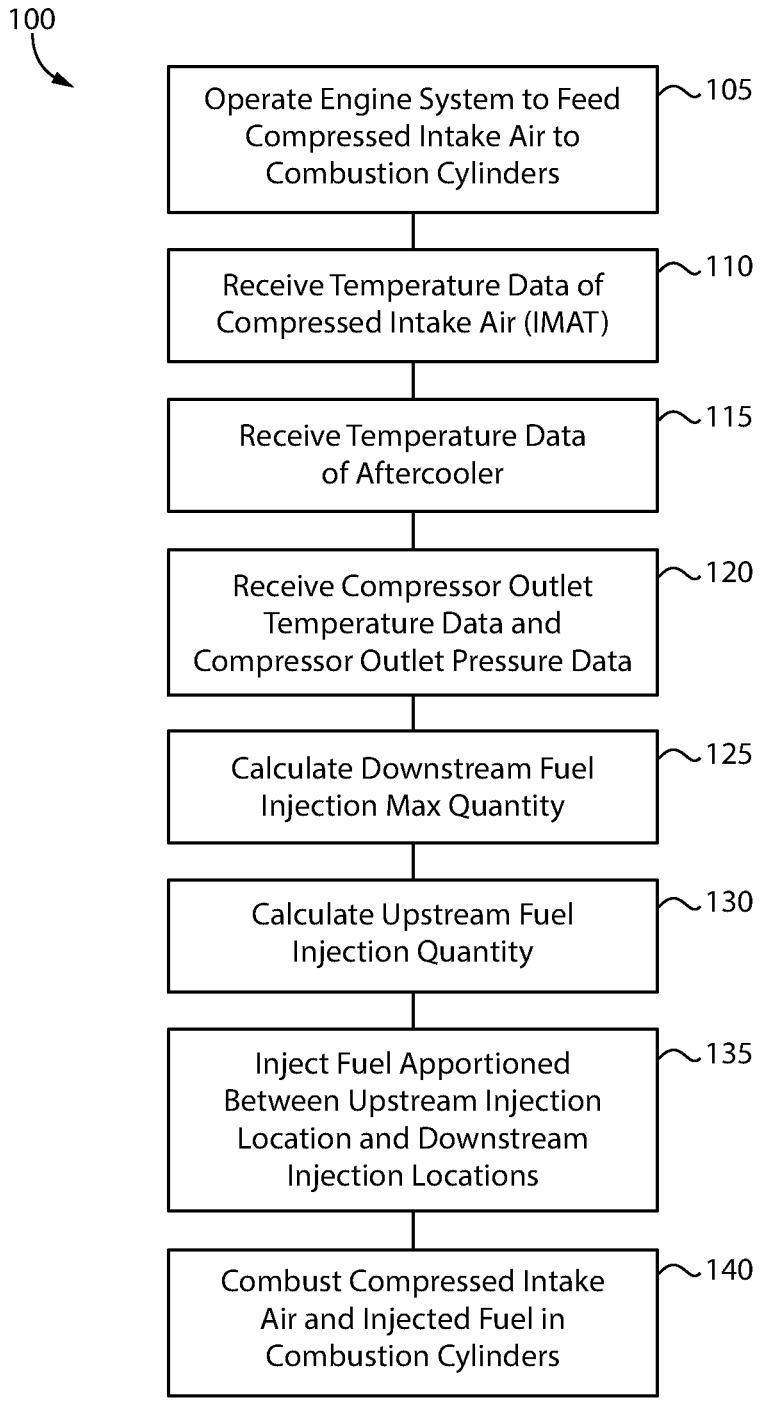
FIG. 2 is a flowchart illustrating methodology and logic flow, according to one embodiment.

Referring also now to FIG. 2, there is shown a flowchart 100 illustrating example methodology and logic flow. At a step 105 engine system 10 is operated to feed compressed intake air to combustion cylinders 16. Those skilled in the art will appreciate the generally conventional operation of turbocharger 34 to compress intake air received from air filter 46 and convey the same through intake conduit 48. At a block 110 temperature data of compressed intake air is received, including IMAT temperature data. At a block 115 temperature data of aftercooler 36 is received as described herein, and at a block 120 compressor outlet temperature data and compressor outlet pressure data is received. It will be appreciated in view of the above description that the temperature data and pressure data can be sensor outputs from physical sensors or data derived from virtual sensor calculations.

From block 120 flowchart 100 advances to a block 125 to calculate downstream fuel injection max quantity. From block 125 flowchart 100 advances to a block 130 to calculate the upstream fuel injection quantity. It will be appreciated that logic blocks 125 and 130 may represent the fuel injection quantity calculations that provide for the apportionment of a total injected quantity of the liquid fuel between the upstream injection location and the plurality of downstream injection locations, based on a temperature parameter of the compressed intake air. From block 130 flowchart 100 advances to a block 135 to inject the fuel apportioned between the upstream injection location and the plurality of downstream injection locations, injecting the liquid fuel into the stream of compressed intake air at an upstream injection location fluidly between compressor 32 and aftercooler 36, and injecting the liquid fuel at the plurality of downstream injection locations into a plurality of streams of the compressed intake air from intake manifold 30 to combustion cylinders 16.

It should also be appreciated that variations in cylinder operation can motivate balancing amongst the separate combustion cylinders. Based, for example, upon monitored cylinder pressure of individual combustion cylinders 16, using pressure sensors 68, combustion cylinders 16 may be balanced or normalized by varying fuel injection quantities injected at the plurality of downstream injection locations. Another way to understand this aspect of the control logic is that a downstream fuel injection max quantity is determined, but some variation below that max quantity in some combustion cylinders may be employed to obtain equal or close to equal power outputs amongst the individual combustion cylinders 16.

From block 135 flowchart 100 advances to a block 140 to combust compressed intake air and injected fuel in combustion cylinders 16. It will be recalled that engine system 10 may employ pilot ignition, thus the combustion in combustion cylinders 16 can include the injected liquid alcohol fuel from the upstream injection location and the downstream locations as well as the directly injected liquid compression ignition fuel. As also noted above, spark-ignition or some other ignition strategy could alternatively be used.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of operating an engine comprising:

feeding compressed intake air from a compressor to a plurality of combustion cylinders in an engine;

injecting a liquid fuel into a stream of the compressed intake air at an upstream injection location fluidly between the compressor and an aftercooler;

injecting the liquid fuel at a plurality of downstream injection locations into a plurality of streams of the compressed intake air from an intake manifold to the plurality of combustion cylinders;

apportioning a total injected quantity of the liquid fuel between the upstream injection location and the plurality of downstream injection locations based on a temperature parameter of the compressed intake air; and combusting the compressed intake air and the injected fuel in the plurality of combustion cylinders.

2. The method of claim 1 wherein the temperature parameter includes a temperature of the compressed intake air at a location fluidly between the aftercooler and the plurality of downstream injection locations.

3. The method of claim 1 wherein the apportioning of the total injected quantity of the liquid fuel further includes determining a downstream injection quantity based on the temperature parameter.

4. The method of claim 3 further comprising balancing the plurality of combustion cylinders by varying fuel injection quantities at the plurality of downstream injection locations.

5. The method of claim 3 wherein the apportioning of the total injected quantity of the liquid fuel further includes injecting a balance of the total injected quantity of the liquid fuel at the upstream injection location.

6. The method of claim 5 further comprising limiting a quantity of the liquid fuel injected at the upstream injection location based on a liquid fuel evaporation limit of the compressed intake air.

7. The method of claim 6 further comprising compensating for the limitation to the quantity of the liquid fuel injected at the upstream injection location by increasing a quantity of a second fuel combusted in the plurality of combustion cylinders.

8. The method of claim 7 wherein the liquid fuel includes methanol, and the second fuel includes a compression-ignition liquid fuel directly injected into the plurality of combustion cylinders.

9. The method of claim 1 wherein the liquid fuel includes a liquid alcohol fuel.

10. An engine system comprising:

an engine having a plurality of combustion cylinders formed therein:

an intake system including an intake manifold, a compressor, and an aftercooler arranged to cool a stream of compressed intake air from the compressor to the intake manifold;

an upstream fuel injector arranged to inject a liquid fuel at an upstream injection location into the stream of compressed intake air from the compressor to the intake manifold;

a plurality of downstream fuel injectors each arranged to inject the liquid fuel at one of a plurality of downstream injection locations into streams of compressed intake air from the intake manifold to each of the plurality of combustion cylinders;

a temperature sensor structured to monitor a temperature of the compressed intake air; and a fueling control unit coupled to the temperature sensor and structured to apportion a total injected quantity of the liquid fuel between the upstream injection location and the plurality of downstream injection locations based on the monitored temperature.

11. The engine system of claim 10 wherein the temperature sensor is arranged to monitor a temperature of the compressed intake air at a location fluidly between the aftercooler and at least one of the downstream injection locations.

12. The engine system of claim 10 wherein the fueling control unit is further structured to:

determine a compressor outlet temperature value;

determine a compressor outlet pressure value; and limit an injected quantity of the liquid fuel at the upstream injection location where the compressor outlet temperature value and the compressor outlet pressure value are indicative of a liquid fuel evaporation limit of the compressed intake air.

13. The engine system of claim 10 wherein the fueling control unit is further structured to:

determine an aftercooler temperature value; and perform the apportionment of the total injected quantity of the liquid fuel, or limit the total injected quantity of the liquid fuel, based on the determined aftercooler temperature value.

14. The engine system of claim 10 further comprising:

a liquid alcohol fuel supply fluidly connected to each of the upstream fuel injector and the plurality of downstream fuel injectors;

a plurality of direct injection fuel injectors; and a liquid compression ignition fuel supply fluidly connected to each of the plurality of direct injection fuel injectors.

15. A fuel system for an internal combustion engine comprising:

an upstream fuel injector structured to inject a liquid alcohol fuel into a stream of compressed intake air from a compressor to an intake manifold of the internal combustion engine;

a plurality of downstream fuel injectors each structured to inject the liquid alcohol fuel into a different stream of compressed intake air from the intake manifold to one of a plurality of combustion cylinders of the internal combustion engine; and a fueling control unit structured to apportion a total injected quantity of the liquid alcohol fuel for injection between the upstream fuel injector and the plurality of downstream fuel injectors based on a temperature of the compressed intake air.

16. The fuel system of claim 15 wherein the fueling control unit is further structured to:

determine a compressor outlet temperature value;

determine a compressor outlet pressure value; and limit an injected quantity of the liquid fuel by way of the upstream fuel injector where the compressor outlet temperature value and the compressor outlet pressure value are indicative of a liquid fuel evaporation limit of the compressed intake air.

17. The fuel system of claim 16 wherein the fueling control unit is further structured to:

determine an aftercooler temperature value; and perform the apportionment of the total injected quantity of the liquid fuel, or limit the total injected quantity of the liquid fuel, based on the determined charge air cooler temperature value.

18. The fuel system of claim 16 wherein the fueling control unit is further structured to:

determine a downstream injection quantity based on the temperature of the compressed intake air; and inject a balance of the total injected quantity of the liquid fuel by way of the upstream fuel injector.

19. The fuel system of claim 15 further comprising a liquid alcohol fuel supply fluidly connected to each of the upstream fuel injector and the plurality of downstream fuel injectors.

20. The fuel system of claim 15 further comprising a temperature sensor arranged to monitor a temperature of the compressed intake air at a location fluidly between an aftercooler and at least one of the downstream injection locations.

* * * * *